United States Patent [19]

Johnston

[11] Patent Number: 4,742,645

[45] Date of Patent: May 10, 1988

[54] POCKET-DOOR ASSEMBLY

[75] Inventor: James R. Johnston, Spring Lake, Mich.

[73] Assignee: National Manufacturing Co., Sterling, Ill.

[21] Appl. No.: 926,135

[22] Filed: Nov. 3, 1986

[51] Int. Cl.[4] ..... E05F 11/54

[52] U.S. Cl. ..... 49/372; 49/380; 49/409; 49/504

[58] Field of Search ..... 49/372, 409, 410, 411, 49/380, 504, 505

[56] References Cited

U.S. PATENT DOCUMENTS

| | | | |
|---|---|---|---|
| 2,732,919 | 1/1956 | Johnson, Jr. | 49/372 |
| 2,818,608 | 1/1958 | Lawrence, III | 49/372 X |
| 2,904,848 | 9/1959 | Liberenz | 49/409 |
| 3,058,174 | 10/1962 | Sterling | 49/372 |
| 3,400,490 | 9/1968 | Anderson | 49/372 |
| 3,480,989 | 12/1969 | Edeus | 49/372 X |
| 4,325,204 | 4/1982 | Martine | 49/372 |
| 4,369,600 | 1/1983 | Passovoy | 49/504 |

*Primary Examiner*—Philip C. Kannan

*Attorney, Agent, or Firm*—Edmond T. Patnaude

[57] ABSTRACT

A pocket-door assembly includes a pair of trolley assemblies fixed to an upper edge of a vertically disposed door. A header member is positioned generally horizontally over the door and comprises a central plate portion with a pair of integrally formed downwardly extending tracks for receiving rollers of the trolley assemblies. The header member is attachable to a standard dimension lumber member of the wood frame structure within which the pocket-door assembly is intended to be inserted, and is preferably a unitary extruded metal structure. A plurality of vertical stud members are fixed at their upper ends to the header member on opposite sides thereof defining a pocket within which the door is receivable. The stud members each comprise a metal channel member having a generally C-shaped cross section into which a standard dimension lumber piece is inserted. The channel members are further formed with recesses for central positioning the lumber pieces and each has a width which is greater than the width of its associated internal lumber piece. The latter feature affords substantial strength to the stud members for firm attachment of a wall covering thereto and provides for the connection of brackets to the stud members for secure and convenient attachment of the stud members to the header member and to the floor.

5 Claims, 4 Drawing Sheets

POCKET-DOOR ASSEMBLY

BACKGROUND OF THE INVENTION

1. Field of the Invention

The present invention relates generally to an improved pocket door assembly, and it relates more particularly to a new and improved pocket-door assembly having distinct advantages of convenient installation in a door frame opening.

2. Description of the Prior Art

Pocket-door assemblies have become an increasingly preferred door system in the construction of residential and commercial building structures. Typically, the pocket-door assembly is mounted within a rough opening provided in a non-bearing partition wall, for example, prior to the installation of plasterboard or another similar wall surface covering. In such an assembly, it is common to suspend the door on a pair of trolley assemblies which ride in a track disposed over the top of the door, and therefore, the door is opened by, essentially, rolling it into a pocket formed by the door assembly and wall surface covering. The advantages of such a system reside in the ability of the pocket assembly to store the door while it is in a open position and thus avoid dedication of room space as is necessary to accommodate a standard hinged door, for example. In order to insure convenience of installation, known pocket-door assemblies are prefabricated structures intended to be inserted into a framed door opening with little or no field modification of the assembly. To this end, pocket-door assemblies of a known type have a multi-component header assembly which includes a pair of generally elongate metallic track members each having a C-shaped cross section and arranged in side-by-side relation so as to receive a trolley assembly fixed to the upper edge of the door. The track members are in closely spaced relation with the open sides of their C-shaped cross section facing one another whereby for stability the trolley assemblies can be constructed with pairs of rollers, each roller of a pair disposed in a respective channel of each track as the trolley assembly translates within the space defined between the two track members. To suspend the tracks within the rough door opening, the ends of the tracks are provided with brackets which may be nailed to vertical side members of the rough frame. The typical pocket-door assembly further includes pairs of relatively thin stud members secured to the floor by bracket members and attached at their upper ends to the metal tracks. The stud members are each fixed to the floor by a bracket member and are attached at their upper ends to the header assembly. The studs therefore serve to provide nailing surfaces adjacent to the finished door opening and thereby define a pocket within which the door can move translationally to assume an open position. To further provide nailing surfaces for the wall covering, the pocket-door header assembly includes wooden strip members fastened along the outer walls of the tracks.

Although prefabricated pocket-door assemblies of the foregoing type are relatively simple to install, it would be desirable to further simplify their construction such that additional manufacturing and installation economies can be achieved. In particular, these assemblies have the disadvantage of comprising a multi-component header assembly which involves a number of manufacturing steps to fabricate. In addition, it would desirable to provide a pocket-door assembly having increased strength whereupon it is capable of supporting, over extended periods of time, wall surface coverings such as ceramic tile, for example, which are easily damaged by vibration occurring with repeated opening and closing of the door.

SUMMARY OF THE INVENTION

Briefly, there is provided in accordance with the teachings of the present invention a new and improved pocket-door assembly comprising a pair of trolley assemblies fixed to an upper edge of a vertically disposed door, each assembly including at least two rollers. A header member is suspended generally horizontally over the door and comprises a central plate portion with a pair of integrally formed downwardly extending tracks for receiving the rollers. In one aspect of the invention the header member further comprises a pair of integral sidewalls extending upwardly therefrom, the sidewalls being spaced from one another to receive a standard dimension lumber member of the wood frame structure within which the pocket-door assembly is inserted. Preferably, the header member is a unitary extruded metal structure and, thus, provides an economical one-piece construction with greater strength than header assemblies heretofore known. A plurality of vertical stud members are fixed at their upper ends to the header member and are disposed on opposite sides thereof defining a pocket within which the door is receivable.

In another aspect, the pocket-door assembly includes vertical stud members comprising a metal channel member having a generally C-shaped cross section and provided with a standard dimension lumber piece inserted therewithin. The channel members are preferably constructed with internal recesses for central positioning the lumber pieces and each has a width which is greater than the width of its associated lumber piece. The recesses and enlarged width of the channel members thereby afford greater strength and stiffness to the stud members for firm attachment of a wall covering thereto and also serve to provide for the convenient attachment of the stud members to the header member and to the floor. dr

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE INVENTION

Figure 1:
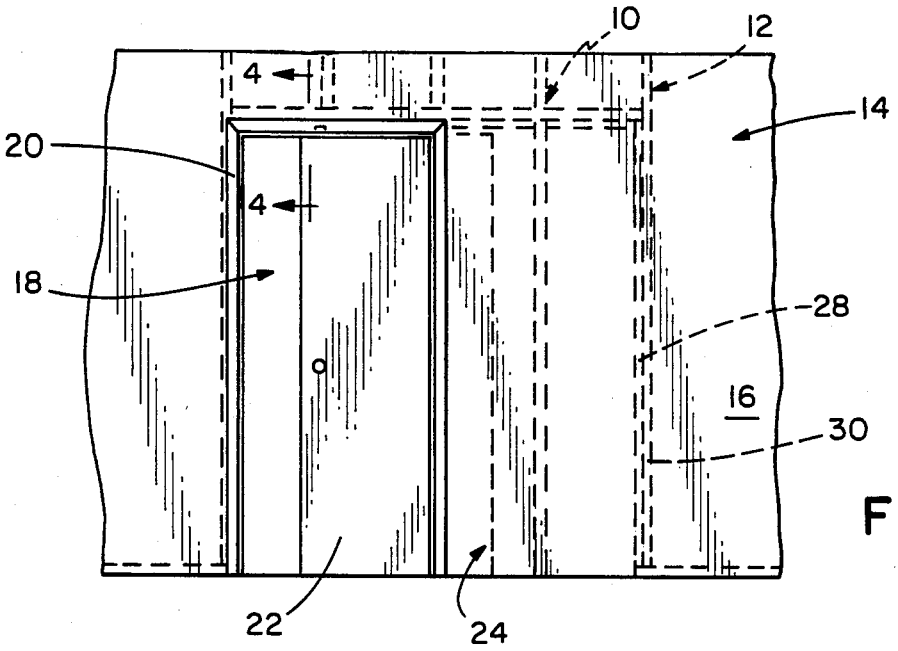
FIG. 1 is an elevational view of a door opening having a pocket-door assembly constructed in accordance with the principles of the invention and installed therein.
Figure 2:
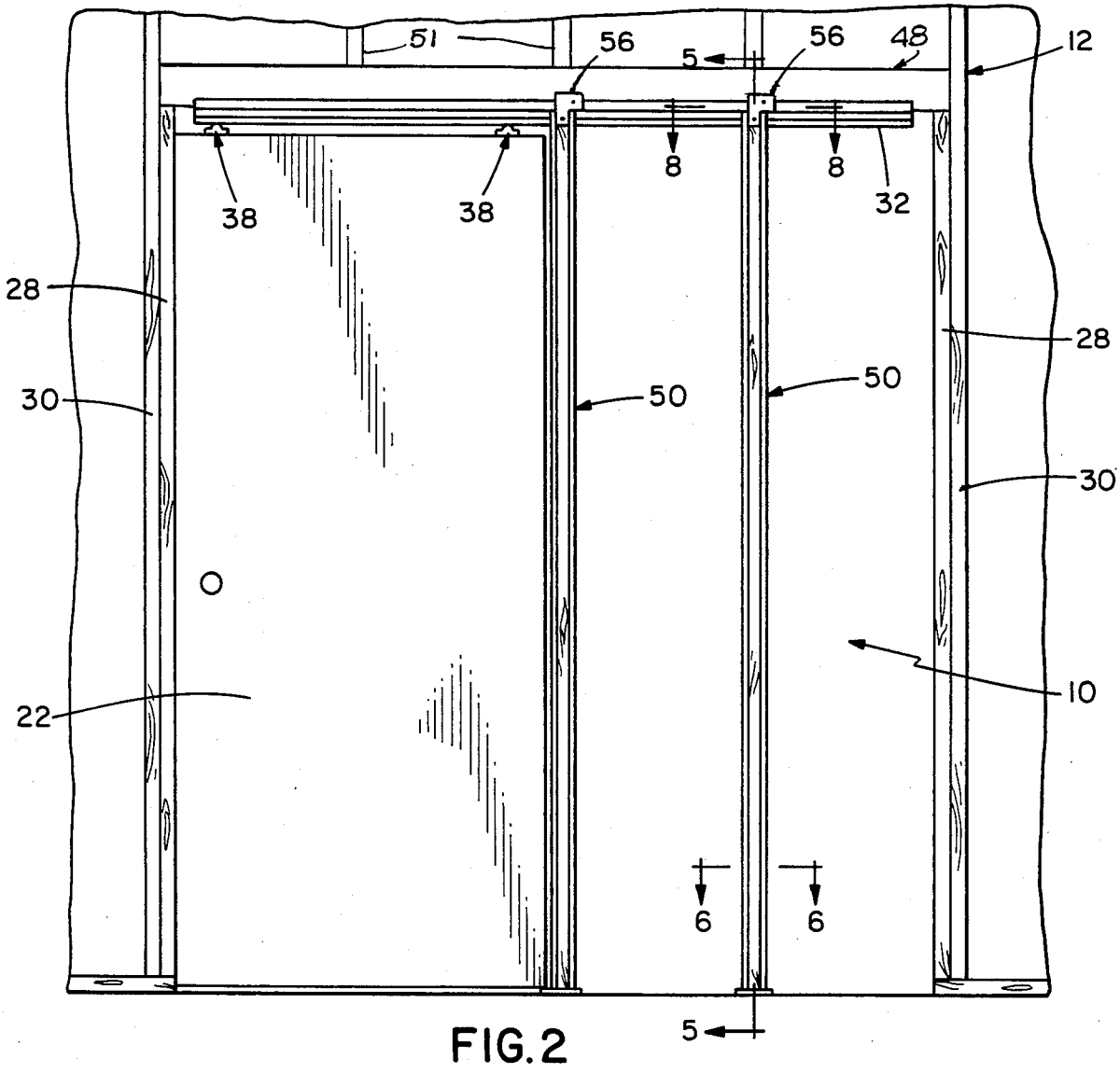
FIG. 2 is an elevational view of the door opening shown in FIG. 1, on an enlarged scale, illustrating the pocket-door assembly of the instant invention with the surrounding wall surface covering removed.

Referring now to the drawings, and initially to FIG. 1, a pocket-door assembly, designated generally by the reference numeral 10 is shown as installed within a rough frame opening 12 of a finished wall assembly, designated generally by the reference numeral 14. The finished wall assembly 14 comprises a wall surface structure of plasterboard 16, or the like, and includes a finished door opening 18 trimmed with a typical casing 20. The illustrated assembly includes a flush door 22 which is mounted for translation into a wall pocket designated generally by the reference numeral 24. As best seen in FIG. 2, the rough opening 12 includes an upper header supported at its ends by a pair of cripples 28 which are, in turn, nailed to a pair of studs 30.

Figure 3:
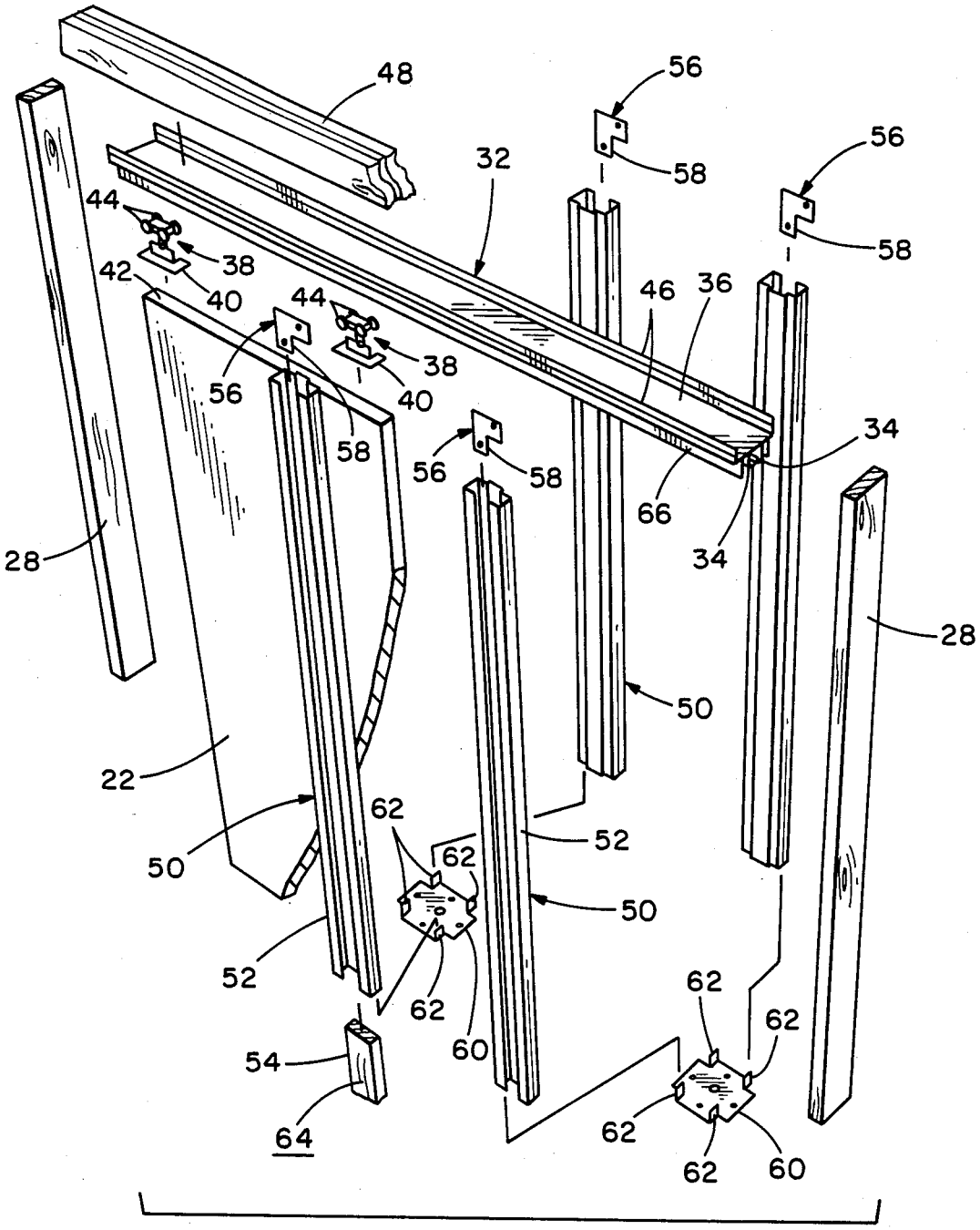
FIG. 3 is an exploded perspective view of a pocket-door assembly constructed in accordance with the principles of the present invention.
Figure 4:
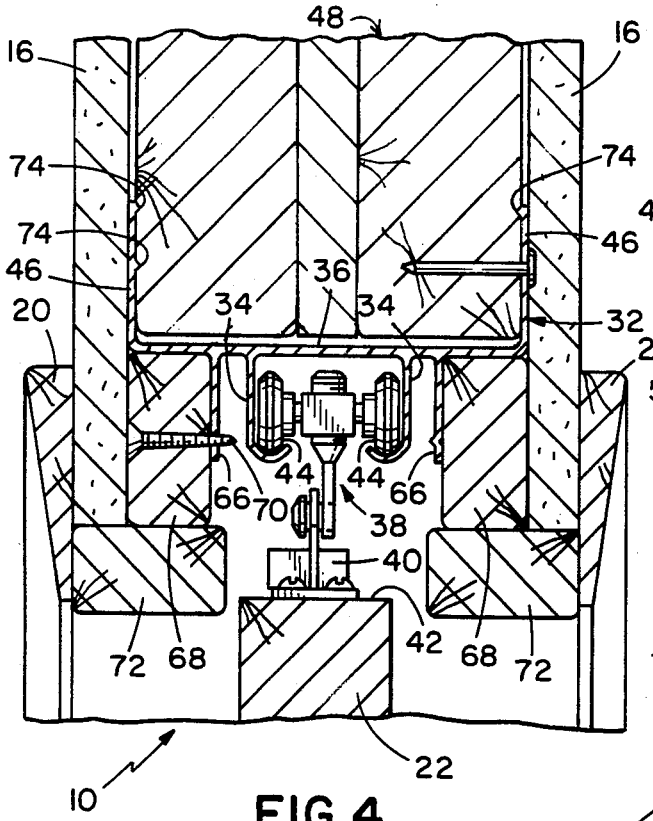
FIG. 4 is a cross-sectional view taken along the line 4—4 of FIG. 1.
Figure 5:
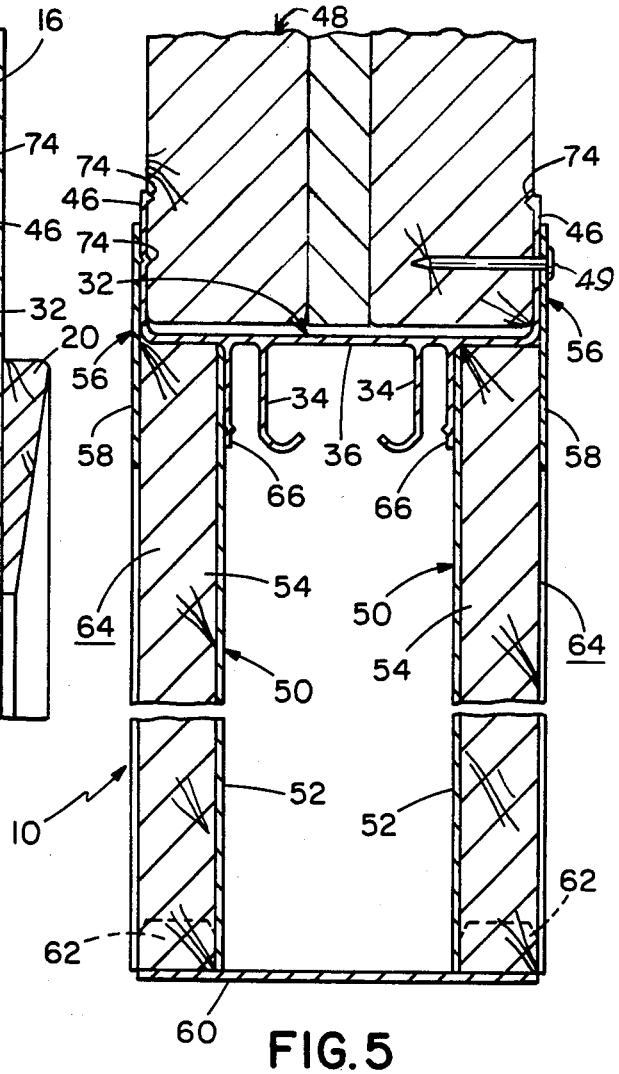
FIG. 5 is a cross-sectional view taken along the line 5—5 of FIG. 2.

Turning now to FIGS. 3, 4 and 5, the component elements of the pocket-door assembly 10 can be seen to include a generally elongate metal header 32 having a pair of opposed track portions 34 extending downwardly from a central plate portion 36. The track portions 34 are generally C-shaped in configuration and are spaced from one another sufficiently to receive a pair of trolley assemblies designated generally by the reference numeral 38. Each trolley assembly 38 comprises a bracket member 40 which is secured, as by wood screws, to the upper edge 42 of the door 22 and includes two pairs of rollers 44, the rollers 44 of each pair being suitably spaced apart from one another so as to ride in the track portions 34 of the metal header 32. Thus, the door 22 is suspended above the floor for translational movement between an opened and a closed position. The metal header 32 further includes a pair of upstanding wall portions 46 disposed at substantially right angles to the central plate portion 36 of the header 32. A header 48 consisting of two pieces of 2×4 lumber and a center wood piece is fitted into the header 32 between the flanges 46 and held in place thereon by a plurality of nails 49 driven through the flanges 46 into the header 48. The header 48 is mounted above the door opening by the studs 30 and by short overhead wood members 51.

In order to provide for a relatively rigid pocket 24 within which the door can be stored, the assembly 10 includes pairs of composite stud assemblies designated generally by the reference number 50. Each composite stud assembly 50 comprises an elongate metal channel member 52 having a generally C-shaped cross-section and dimensioned to receive, therewithin, a standard dimension 1×2 piece of lumber 54. The composite studs 50 are preferably positioned on opposite sides of the metal header 32 and are fixed thereto by stud plates 56. Each stud plate 56 has an ear portion 58 which is insertable between the edges of channel member 52 against the lumber piece 54 of the stud assembly 50 and is nailed to a wall portion 46 of the header 32 to provide rigidity to the pocket enclosure. The stud plates 56 are generally flat and, therefore, they are capable of firmly securing the upper ends of the studs with only slight interference with the application of a wall surface covering 16 over the assembly 10. At their lower ends, the composite stud assemblies 50 are secured to the floor by a floor plate 60. In a preferred embodiment of the pocket-door assembly 10 shown, each floor plate 60 is provided with multiple pairs of upstanding tangs 62 so configured as to be received within the interior of the channel members 52. The foregoing means for fastening of the composite stud assembly 50 provides for a pocket 24 having uniform interior dimensions as well as uniform exterior dimensions approximating the thickness of a standard 2×4 framed wall 14. Outward opening of the channel members 52 permits a surface 64 of the 1×2 lumber piece to be exposed exteriorly of the pocket 24 thus providing a nailing surface for a suitable wall covering 16.

With reference now particularly to FIGS. 4 and 5, the details of a pocket-door assembly 10 of the instant invention can be seen to further include a pair of header wall portions 66 running the length of the metal header 32 and extending downwardly from the central plate portion 36 at right angles thereto. These wall portions 66 provide a plumb surface to which nailing strips 68 may be fastened as by wood screws 70, for example. Upper jamb members 72 are, in turn, fastened to the nailing strips 68 to trim the upper portion of the finished opening 18 in cooperation with the casing 20. In these views, the upper wall portions 46 of the metal header 32 can be seen to further include pairs of lengthwise ribs 74 serving to strengthen the header 32 and also to provide gripping means for firm attachment of the header 32 to frame member 48.

Figure 6:
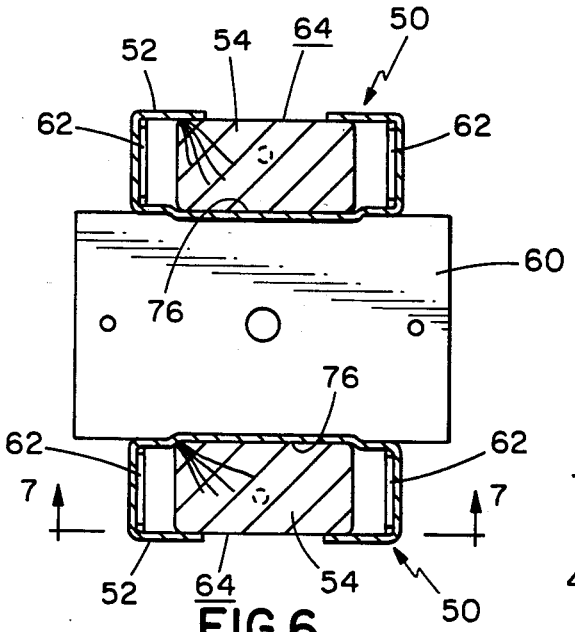
FIG. 6 is a cross-sectional view taken along the line 6—6 of FIG. 2.
Figure 7:
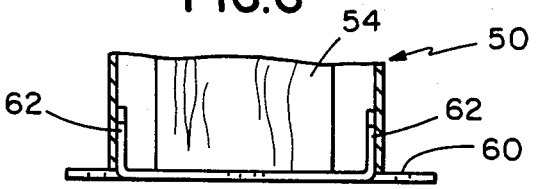
FIG. 7 is a cross-sectional view taken along the line 7—7 of FIG. 6.
Figure 8:
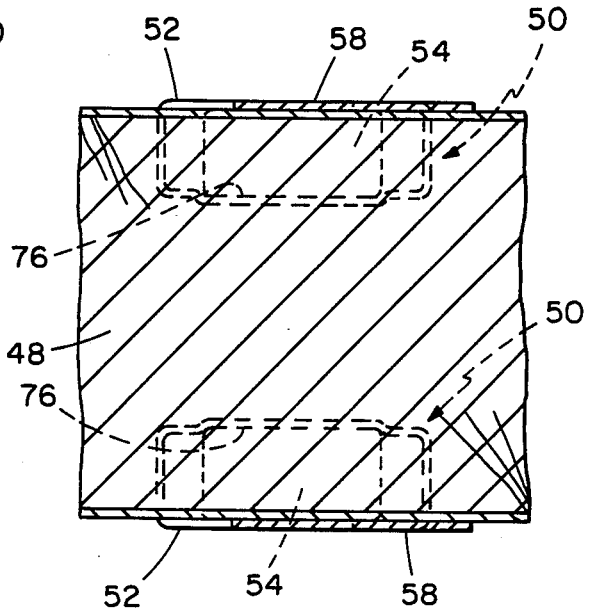
FIG. 8 is a cross-sectional view taken along the line 8—8 of FIG. 2.

Details of the composite stud members 50 of the pocket-door assembly 10 can best be seen in the cross-sectional views of FIGS. 5, 6, 7 and 8. Preferably, the channel member 52 of the stud assembly 50 has a width which is significantly greater in dimension than the 1×2 lumber piece 54 inserted therewithin. Such an arrangement provides for a stud assembly 50 which has increased strength and stiffness against bending moments as would occur during impact against the outside wall surface 16 of the door pocket 24. In addition, the channel members 52 are each constructed with an interior wall configuration defining an internal recess 76. As best seen in FIG. 6, the recess 76 is dimensioned such that it serves to centrally locate the lumber piece 54 within the channel member 52, and also serves to add strength to the composite studs 50.

Figure 9:
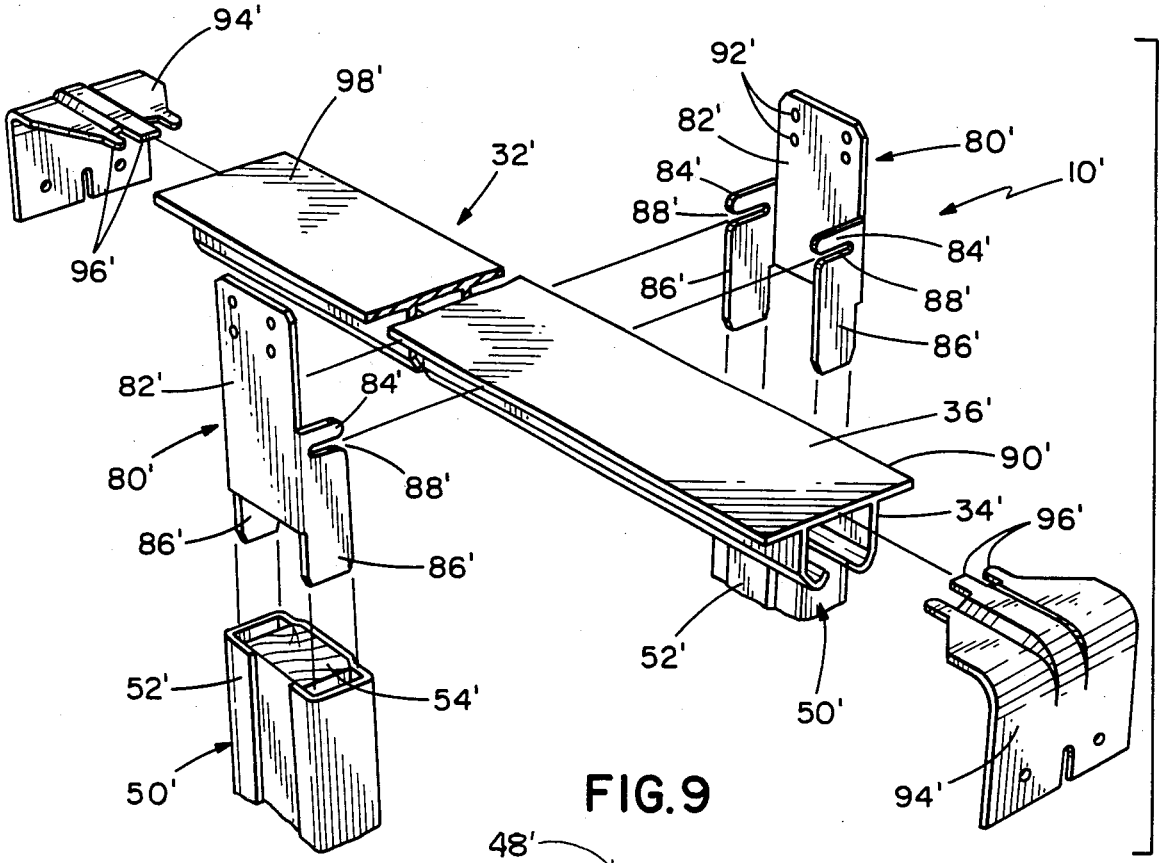
FIG. 9 is an exploded perspective view illustrating an alternative embodiment of a pocket door assembly constructed in accordance with the principles of the invention.
Figure 10:
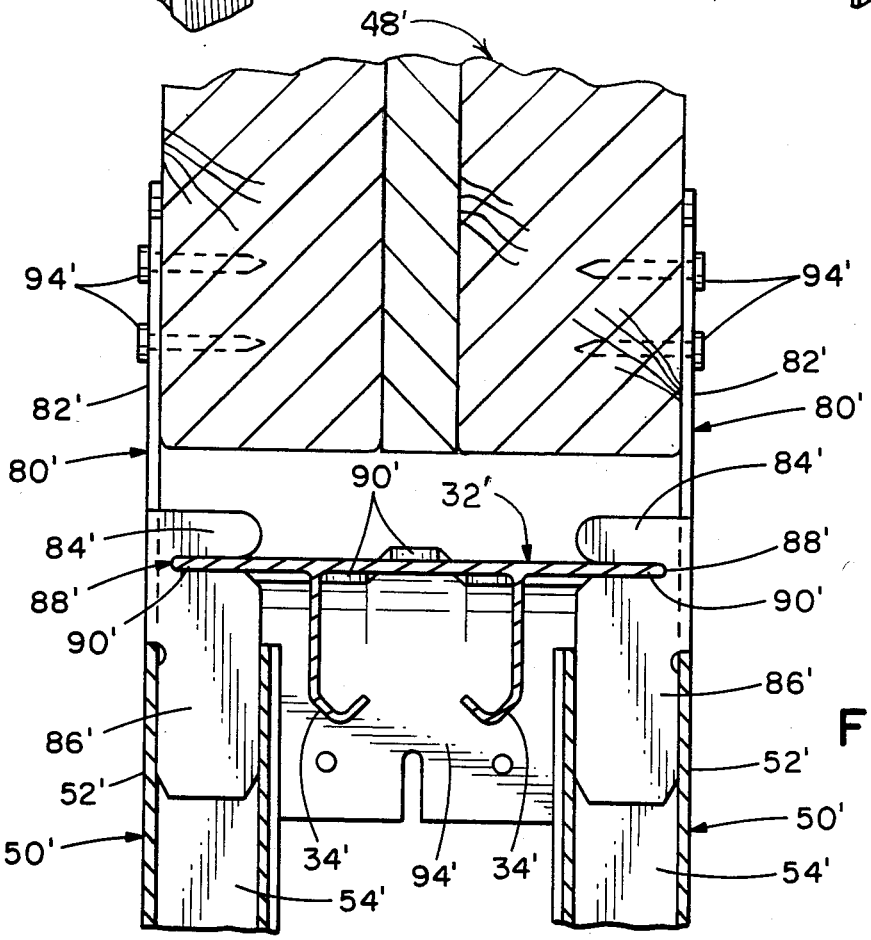
FIG. 10 is a cross-sectional view of the pocket door assembly of FIG. 9 illustrated in fully assembled condition.

In the views of FIGS. 9 and 10, an alternative embodiment of a pocket door assembly 10' is illustrated as including a generally elongate metal header 32' having a pair of opposed track portions 34' extending downwardly from a central plate portion 36'. As in the case of the header 32 illustrated in FIGS. 1–5, the header 32' of the alternative embodiment illustrated in FIGS. 9 and 10 is intended to be secured to a standard 2×4 dimension lumber piece 48' which has been installed over the header 32' as part of the rough opening for the pocket door assembly 10'. To this end, the central plate portion 36' of the header 32' is configured to have a width which approximates the width of a standard 2×4 piece of lumber. In order to securely attach the header 32' to the lumber piece 48', in accordance with the invention, there are provided a plurality of bracket members 80' each having a plate portion 82', a pair of laterally extending arm portions 84' and a pair of downwardly extending leg portions 86'. The brackets 80' are attachable to edges 90' of the central plate portion 36' of the header 32' by the provision of slots 88' formed between the arm portions 84' and leg portions 86' of the brackets 80'. A plurality of holes 92' are formed in the plate portion 82' of the brackets 80' in order to provide for attachment of the brackets 80' to the lumber piece 48 by the use of suitable nails 94'.

In order to form a pocket within which a door can be received, composite stud members 50' comprising a generally C-shaped channel member 52' and a central wood member 54' are connectable to the bracket members 80' by insertion of the leg portions 86' of the brackets 80' into the interior space of the channel members 52' of the composite studs 50'. Thus, the brackets 80' not only serve to suspend the header 32' from a frame member 48', they also serve to provide attachment means for suitably locating stud members 50' to which a wall surface covering may thereafter be attached. The ends of the header 32' are also secured to the frame structure of the rough opening by end brackets 94' (only one of which can be seen) configured with a plurality of staggered tangs 96' which are dimensioned to slidingly receive end edges 98' of the header 32'.

OPERATION

The advantages of a pocket-door assembly 10 as illustrated in FIGS. 1–8 can be appreciated in the context of its manufacturability and its installation simplicity. Preferably, the metal header 32 is an integrally formed member in which track portions 34, central plate member 36, upper wall portions 46 and lower wall portions 66 are all extruded as a unitary structure. Not only is such a structure convenient to manufacture, in installation the header 32 is simply nailed at regular spaced intervals to the standard 2×4 frame member 48 or is nailed directly to a frame header 26 of the rough frame opening 12. The spacing of the upper wall portions 46 to accommodate a standard 2×4 frame member permits the pocket-door assembly 10 to be installed in virtually any standard interior wall 14 of a building. Following hanging of the metal header 32 with the trolley assemblies 38 already positioned in the track portions 34 of the header 32, the floor plates 60 are then fastened to the floor immediately beneath the metal header 32, and the composite stud assemblies 50 are inserted over the tangs 62 of the floor plates 60. The upper ends of the composite stud assemblies 50 are then secured to the wall portions 46 of the header 32 using stud plates 56. Nailing strips 68 are then secured to the downwardly extending wall portions 66 in between the composite stud assemblies 50. After the wall covering 16, such as plasterboard, is applied, jamb members 72 are then fastened to the nailing strips 68 followed by installation of the casing 20 thereby providing a completely finished opening 18. The door 22 may then be hung from the trolley assemblies 38 by securing the brackets 40 to the upper edge 42 thereof. Thus, with a relatively few components, there is provided in accordance with the present invention a pocket-door assembly 10 having ease of installation and economy of manufacture.

Likewise, the pocket door assembly 10' as illustrated in FIGS. 9 and 10 offers similar advantages of manufacturability and installation simplicity. The metal header 32' is preferably an integrally formed member in which track portions 34' and central plate portion 36' are extruded as a unitary structure. During installation, the header 32' is simply secured within a framed rough opening by the two end brackets 94', and then brackets 80' are driven into engagement with the edges 90' of the header 32', each bracket 80' carrying an attached stud assembly 50' whereupon the pocket for the door is formed. Finally, the brackets 80' are nailed to the frame member 48' thereby permanently locating the studs 50' and providing additional support for the header 32'.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A pocket door assembly for installation in a frame structure comprising a vertically disposed door;

a pair of trolley assemblies fixed to an upper edge of said door, said assemblies each including at least one pair of spaced apart rollers;

an integrally formed header member suspended generally horizontally over said door and comprising a central plate portion with a pair of downwardly extending spaced apart tracks receiving said rollers;

a plurality of vertical stud members fixed at their upper ends to said header member and disposed on opposite sides of said header member defining a pocket within which said door is receivable;

said stud members each comprising a channel member;

a plurality of brackets each having a depending leg portion received within a channel member of a respective one of said stud members for connection of said stud members to said header, said plate portion of said header being configured to define a plurality of laterally projecting edges, and said brackets are respectively connected to one of said edges.

2. The pocket-door assembly of claim 1 wherein said brackets each comprise an arm portion and said arm portion is cooperable with said leg portion to define a slot therebetween, said edges of said header plate portion being received by said slots to connect said bracket to said header member.

3. A pocket door assembly according to claim 1, wherein each of said brackets has an upstanding plate portion provided with at least one hole therein.

4. A pocket door assembly according to claim 3, comprising a piece of lumber disposed above and parallel to said header member, and attachment means extending through said holes in said brackets into said piece of lumber.

5. A pocket door assembly according to claim 4, wherein each of said brackets comprises a plurality of arm portions respectively spaced from said leg portions to define slots between said arm portions and said leg portions, and said edges of said plate portion of said header are disposed in said slots to attach said header to said brackets.

* * * * *